United States Patent [19]

Marulic

[11] 4,241,552

[45] Dec. 30, 1980

[54] PARTITION WALL JOINT

[75] Inventor: Walter J. Marulic, Gary, Ind.

[73] Assignee: Pullman Incorporated, Chicago, Ill.

[21] Appl. No.: 890,444

[22] Filed: Mar. 27, 1978

[51] Int. Cl.[2] ..... E04B 1/00

[52] U.S. Cl. ..... 52/282; 52/466

[58] Field of Search ..... 52/282, 469, 281, 287, 52/288, 466

[56] References Cited

U.S. PATENT DOCUMENTS

| | | | |
|---|---|---|---|
| 2,363,164 | 11/1944 | Waller | 52/282 |
| 2,708,494 | 5/1955 | Larsen | 52/281 |
| 2,838,592 | 6/1958 | Feketics | 52/282 |
| 3,038,571 | 6/1962 | Clements | 52/469 |
| 3,222,836 | 12/1965 | Collin | 52/281 |
| 3,387,415 | 6/1968 | McFarlane | 52/394 |
| 4,015,399 | 4/1977 | Prins | 52/282 |

FOREIGN PATENT DOCUMENTS

| | | | |
|---|---|---|---|
| 1123761 | 9/1956 | France | 52/282 |

*Primary Examiner*—Ernest R. Purser
*Assistant Examiner*—Henry E. Raduazo
*Attorney, Agent, or Firm*—Richard J. Myers

[57] ABSTRACT

A partition wall joint for joining three converging partition walls in a passenger vehicle. The joint includes a vertical anchor post generally hat-shaped in horizontal cross-section and a removable anchor plate generally coextensive and cooperative with the post so as to define three outwardly opening vertical channels wherein the respective partition walls may be secured as desired.

4 Claims, 3 Drawing Figures

FIG. 1
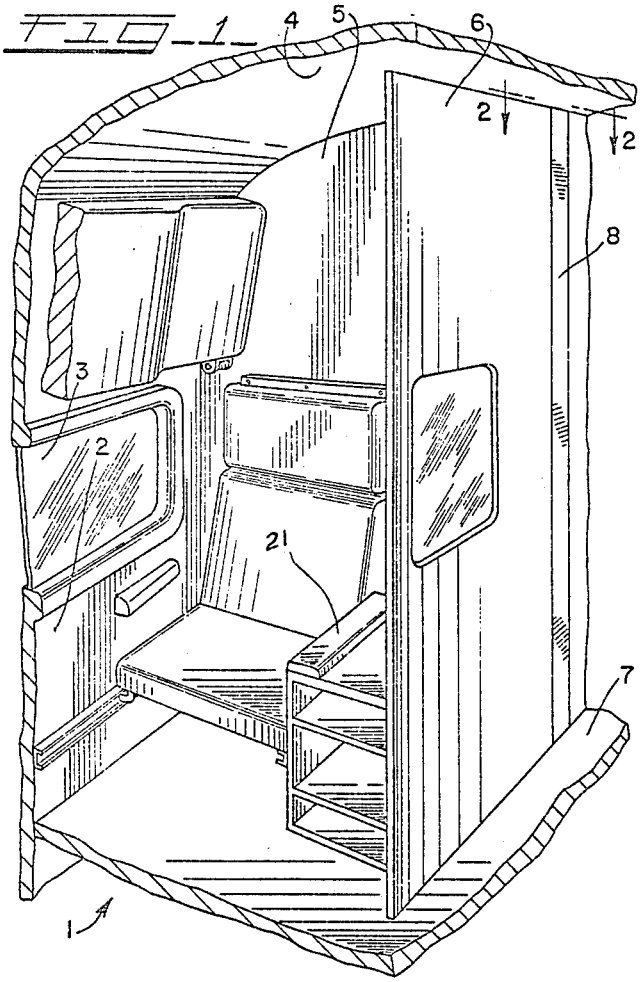
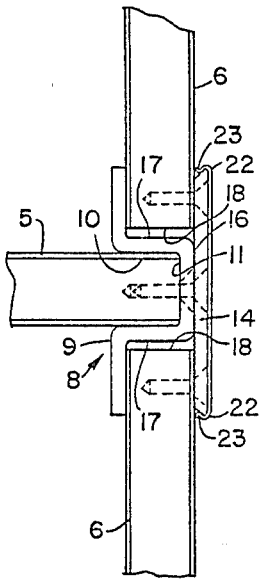
FIG. 2
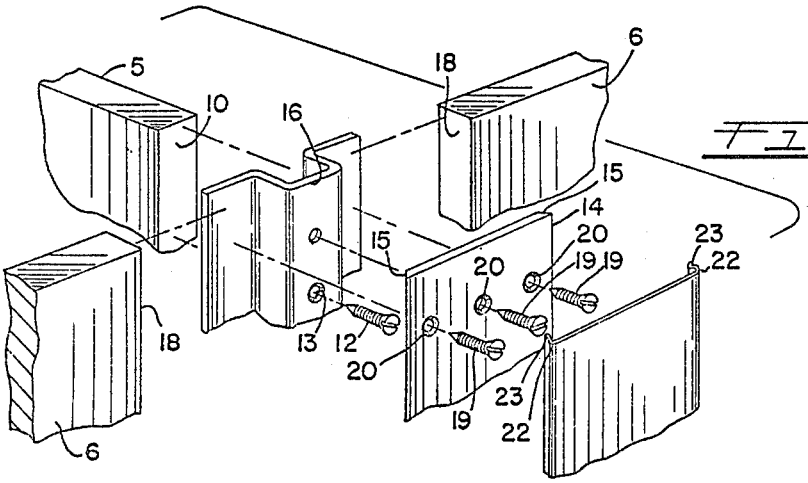
FIG. 3

PARTITION WALL JOINT

BACKGROUND OF THE INVENTION

1. Field of the Invention

The present invention pertains to railway compartments and in particular to compartment partition wall joint constructions.

2. Description of the Prior Art

The prior art wall or panel joint constructions are illustrated by U.S. Pat Nos. 3,387,415; 3,521,419 and 3,742,668. None, however disclose the improved partition wall or panel joint construction of the present invention which accommodates quick assembly and disassembly or repair and replacement of wall panels.

SUMMARY OF THE INVENTION

In a railway car having a number of passenger compartments, it is desirable to provide for the relatively quick assembly and repair or removal of the compartment walls within the confined space of the car structure to reduce the complexity and cost of construction and to enhance the maintainability of the car while it is in service.

In the present invention a partition wall joint is disclosed which accommodates quick assembly and disassembly or repair or replacement of the wall panels. Specifically, the invention provides for a vertical anchor post of a generally hat-shaped cross-section at the juncture of the inner walls of adjacent compartments and the common transverse wall between them. The inner end portion of the transverse wall is sandwiched and secured within the channel of the hat-shaped post and the vertical edge portions of the inner walls secured in vertical channels or grooves formed by brim-like portions of the hat-shaped post and an easily removable vertical anchor plate secured to the post and the inner walls after the common transverse wall is secured to the post. Thereafter a decorative and protective cover plate is snapped or otherwise secured to the vertical anchor plate.

BRIEF DESCRIPTION OF THE DRAWINGS

FIG. 1 is a perspective view of the interior one-half portion of a seating and sleeping compartment of a railway passenger car;

FIG. 2 is a plan sectional view taken substantially along line 2—2 of FIG. 1;

FIG. 3 is an exploded perspective view illustrating a joint assembly.

DESCRIPTION OF THE PREFERRED EMBODIMENT

As shown in FIG. 1 a railway car compartment or bedroom 1 includes a car side or outer compartment wall 2 having an outside window 3, a roof or ceiling structure 4, longitudinally spaced transversely extending partition walls 5, and a lateral or inner wall 6. In FIG. 1, one-half of the compartment is shown, it being recognized that the other half is essentially identical and that a plurality of compartments are provided on opposite sides of the car and are sufficiently spaced apart to provide a suitable aisle generally designated at 7.

Referring now particularly to FIGS. 2 and 3, the partition wall joint construction 8 of the present invention includes a vertical anchor post 9, generally hat-shaped in horizontal cross-section, wherein the inner end portion 10 of the transverse wall 5 is sandwiched within the vertical inner channel portion or groove 11 of the post 9 and secured therein by a plurality of vertically spaced anchor screws 12 through holes 13 (only one of which is shown in the drawings). An anchor plate 14 having outwardly chamfered vertical edges 15 is provided which may be secured to the outer channel portion 16 of the post 9 to form oppositely opening grooves or slots 17 in which the edge portions 18 of the inner walls 6 are secured by a plurality of vertical spaced anchoring screws 19 through holes 20 (vertical spacing not shown in the drawings). A snap-on trim member 21 is also provided which includes converging vertical edge portions 22 which are dovetailingly engaged about chamfered edges 15 to secure the trim member to the plate 14. As the trim member may be of metal or other slightly resilient material, flaired ends 23 are provided for the vertical edge portions 22 to accommodate snapping or springing the member 21 securely onto the plate 14; and conversely, by inserting a screwdriver or the like beneath the flared ends 23, the trim member 21 may be unsnapped or pried loose so as to remove it from the plate 14.

It should be particularly noted that the wall joint construction of the present invention is uniquely suited for use in confined areas such as a sleeper compartment; e.g., during construction of the car as well as when it is necessary to repair or replace the compartment walls, the joint may be easily assembled and disassembled in a manner allowing the walls to be moved or set in place sideways instead of endwise whereafter they may be efficiently and easily secured in place by screws 12 and 19.

Having disclosed the preferred embodiment of the invention it will be understood by those skilled in the art that various other forms of the invention will come within the scope of the amended claims.

What is claimed is:

1. In a passenger vehicle having compartment partition walls converging to form a wall joint, the improvement comprising a partition-wall joint adapted to secure generally adjacent vertical edge portions of first and second longitudinal partition walls and a third partition wall having a vertical edge portion generally interposed between said edge portions of said first and second walls and extending generally transversely therefrom, comprising:

a vertical anchor post generally hat-shaped in horizontal cross-section and including a channel having inner and outer portions, said inner channel portion adapted to receive the vertical edge portion of said third wall, and said post having brim flange portions extending longitudinally from said channel in spaced parallel relation to said outer channel portion and adapted to engage first sides of said first and second walls, said outer channel portion being in general alignment with second sides of said first and second walls, an anchor plate generally co-extensive and cooperative with the post and positioned adjacent to said outer channel portion to define oppositely longitudinally opening slots formed by each brim flange portion and the anchor plate, said anchor plate adapted to engage second sides of said first and second walls and to sandwich respective vertical edge portions of the first and second walls between said flange portions and said anchor plate in generally flush relation with said outer channel portion, and first fastening means extending from said outer channel portion into said third wall adapted to couple said post and third wall, second fastening means adapted to couple said plate and post, and third fastening means extending through said plate and into said first and second walls adapted to secure said first and second walls to the plate, said first, second and third fastening means all being accessible from the same side of the wall joint.

2. The invention according to claim 1, and a removable trim plate member outwardly overlying and concealing said anchor plate.

3. The invention according to claim 2, and said anchor plate having inwardly chamfered vertical edge portions, and said trim plate member having vertical edge portions cooperative therewith removably securing said member to the plate.

4. The invention according to claim 1, and said wall joint being vertically coextensive with said first, second and third walls.

* * * * *